US008701365B2

(12) United States Patent
Rosenthal et al.

(10) Patent No.: US 8,701,365 B2
(45) Date of Patent: Apr. 22, 2014

(54) IMPACT RESISTANT PLASTIC CORNER BEAD

(75) Inventors: Guy L. Rosenthal, Wheaton, IL (US); Aaron C. Rosso, Elmhurst, IL (US); Ronald J. Koval, Aurora, IL (US)

(73) Assignee: United States Gypsum Company, Chicago, IL (US)

( * ) Notice: Subject to any disclaimer, the term of this patent is extended or adjusted under 35 U.S.C. 154(b) by 200 days.

(21) Appl. No.: 12/844,342

(22) Filed: Jul. 27, 2010

(65) Prior Publication Data

US 2011/0023392 A1 Feb. 3, 2011

Related U.S. Application Data

(60) Provisional application No. 61/230,225, filed on Jul. 31, 2009.

(51) Int. Cl.
*E04B 2/00* (2006.01)

(52) U.S. Cl.
USPC ..... 52/287.1; 52/254; 52/255

(58) Field of Classification Search
CPC ..... E04F 13/06; E04F 19/022; E04F 19/028; E04F 21/00
USPC ..... 52/287.1, 255, 254; 428/77, 189
See application file for complete search history.

(56) References Cited

U.S. PATENT DOCUMENTS

| | | | | |
|---|---|---|---|---|
| 1,587,034 | A * | 6/1926 | Planett | 52/257 |
| 4,863,774 | A * | 9/1989 | Tucker | 428/77 |
| 4,876,837 | A * | 10/1989 | Kelly et al. | 52/287.1 |
| 5,045,374 | A * | 9/1991 | Tucker | 428/83 |
| 5,048,247 | A * | 9/1991 | Weldy | 52/255 |
| 5,131,198 | A * | 7/1992 | Ritchie et al. | 52/287.1 |
| 5,442,886 | A * | 8/1995 | Iacobelli | 52/255 |
| 6,295,776 | B1 * | 10/2001 | Kunz et al. | 52/255 |
| 6,691,476 | B1 * | 2/2004 | Kunz | 52/287.1 |
| 6,691,477 | B2 * | 2/2004 | Koenig. Jr. et al. | 52/287.1 |
| 6,722,092 | B2 * | 4/2004 | Kunz et al. | 52/255 |
| 7,137,231 | B2 * | 11/2006 | Harel | 52/746.1 |
| 7,165,373 | B2 * | 1/2007 | Smythe, Jr. | 52/746.1 |
| 7,383,668 | B1 * | 6/2008 | Kunz | 52/255 |
| 8,511,016 | B2 * | 8/2013 | Smythe, Jr. | 52/255 |
| 2003/0110721 | A1 * | 6/2003 | Harel | 52/287.1 |
| 2004/0093816 | A1 | 5/2004 | Smythe | |
| 2004/0163340 | A1 * | 8/2004 | Harel | 52/287.1 |
| 2006/0059809 | A1 | 3/2006 | Smythe | |
| 2006/0070324 | A1 * | 4/2006 | Daly, IV | 52/287.1 |
| 2006/0101746 | A1 | 5/2006 | Smythe | |
| 2007/0022688 | A1 * | 2/2007 | Fisher | 52/364 |
| 2007/0107336 | A1 * | 5/2007 | Conboy | 52/255 |
| 2008/0041006 | A1 * | 2/2008 | Harel | 52/465 |
| 2011/0030297 | A1 * | 2/2011 | Robertson | 52/255 |
| 2013/0186024 | A1 * | 7/2013 | Rosentiel et al. | 52/255 |

FOREIGN PATENT DOCUMENTS

| | | |
|---|---|---|
| WO | WO 98/37290 | 8/1998 |

* cited by examiner

*Primary Examiner* — Robert Canfield
*Assistant Examiner* — Matthew Gitlin
(74) *Attorney, Agent, or Firm* — Greer, Burns & Crain, Ltd.; Pradip Sahu; Philip T. Petti

(57) ABSTRACT

A corner bead for finishing a wallboard corner joint is provided, including a plastic body including a first flange and a second flange, each flange having a rib edge and an opposite free edge. The respective rib edges are joined to form a corner rib defining an angle. A web of face paper covers at least a portion of the body.

13 Claims, 6 Drawing Sheets

IMPACT RESISTANT PLASTIC CORNER BEAD

RELATED APPLICATION

This application claims priority pursuant to 35 USC 119(e) from U.S. Provisional Application Ser. No. 61/230,225 filed Jul. 31, 2009.

BACKGROUND

Corner bead products are used in wall finishing for both aesthetics and utility. They finish a rough corner into a pleasing symmetrical transition with the respective adjoining walls, and also provide some resistance to abuse and impact on the corner. To accomplish these tasks, a suitable corner bead product should fit snugly on the wall, be easy to attach, and have material and design properties that allow it to resist at least minor impacts without severe damage or detachment from the wall.

An important feature of prior art metal corner bead is a slightly rounded corner that protrudes from the actual corner of the part. This feature is also known as the "bead", but for purposes of describing the invention, it will be referred to as the "corner rib". In metal corner bead, the rib aids in the finishing of the corner by allowing the finisher to easily apply some significant "fill" of joint compound all the way up to the corner. The rib has a radius of just 0.03-1.10 inch (0.08-2.79 cm) and a preferred maximum height above the corner bead flanges of 0.015-0.024 inch (0.04-0.06 cm), so the surface of the rib itself that is not covered by joint compound is easily painted over for a pleasing finish. If the corner bead simply has a sharp 90° angle at the corner, it is much more difficult to apply a thin layer of joint compound that covers the bead in close proximity to the actual corner and in a way that is able to be sanded to a smooth, paintable finish.

It is known that the core material of corner bead can be plastic, as well as metal. Conventional corner bead products made from steel or aluminum are easily dented upon moderate impact. Known plastic corner bead products typically possess a sharp angle or corner on the spine and are more flexible and less easily dented, but they tend to crack at the corner when held in place by rigid fasteners, or often pull away from the wall when held in place by adhesive or joint compound.

SUMMARY

The present plastic corner bead features a rounded, reinforced "bumper" or corner rib of plastic extending axially at the corner, and is integrally formed with a pair of plastic flanges or wings forming the corner. Preferably, the corner rib is formed along a common edge of the respective flanges. An important feature of the present corner rib is that it absorbs impact energy without breaking the plastic. In addition, the present corner rib is configured so that impacts are not transferred toward the flanges in a way that causes detachment of the flanges from the wall.

It has been found that when the core material is plastic, the corner rib serves an additional purpose. The ability of plastic, unlike metal, to reversibly deform under relatively large forces allows the rounded, hollow bumper or corner rib to act as a shock absorber to provide qualitatively better impact resistance to the corner. Thus, the present plastic corner bead is preferable to a metal rib because it resists denting to a much larger degree, and it is preferable to a conventional sharp plastic corner, or even to a corner rib that is solid plastic, or that is filled with a thin metal rod, because it is able to absorb impact by crushing inward without transferring the impact energy out to the wings or flanges, which are held on the wall by widely separated point fasteners or by relatively weak joint compound. A relatively small deformation in the rib can be easily repaired with SPACKLE® surfacing compound, wallboard joint compound or other repair material, but if the flanges lose their bond to the wall, then the only repair is to replace the entire length of corner bead.

More specifically, a corner bead for finishing a wallboard corner joint is provided, including a plastic body including a first flange and a second flange, each flange having a rib edge and an opposite free edge. The respective rib edges are joined to form a corner rib defining an angle. A web of face paper covers at least a portion of the body.

In another embodiment, a corner bead for finishing a wallboard corner joint is provided, including a plastic body including a first flange and a second flange, each flange having a rib edge and an opposite free edge. The respective rib edges are joined to form a corner rib defining an angle. At least one of the flanges tapers in thickness from the rib edge to the free edge. The corner rib extends beyond a corner defined by the first and second flanges, and has an interior and defines a hollow interior space. A web of face paper at least partially covers the body.

DETAILED DESCRIPTION

Figure 1:
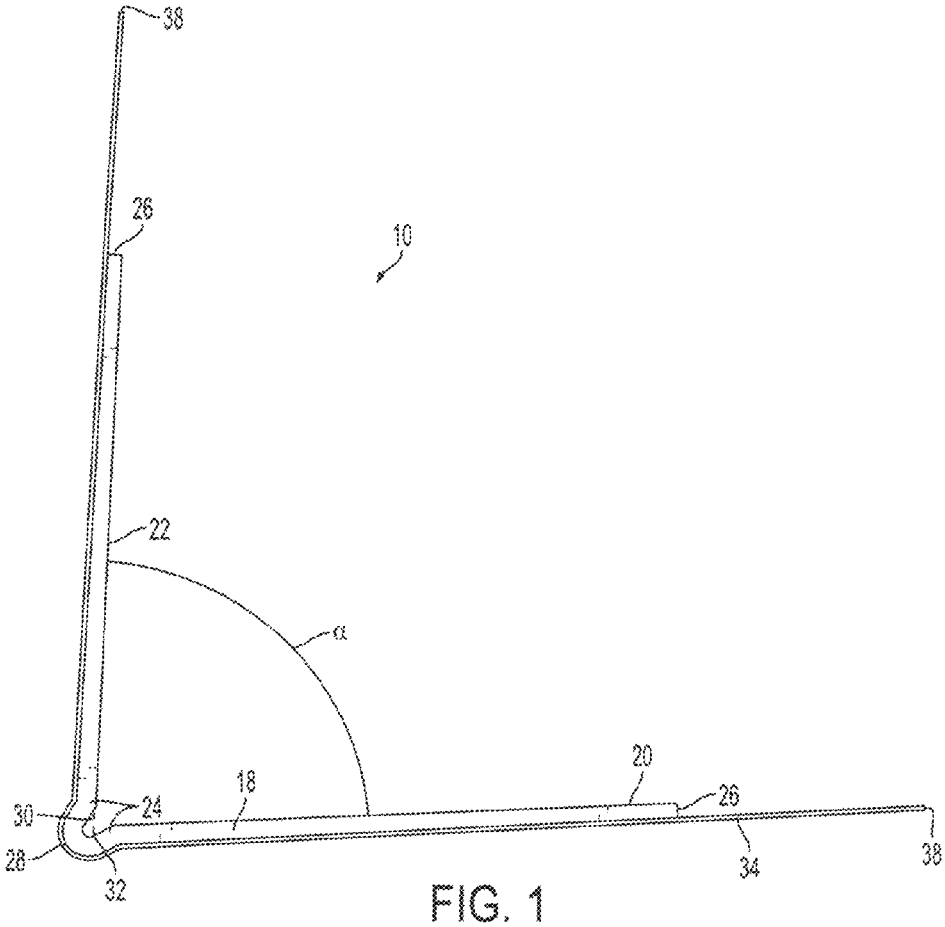
FIG. 1 is an end view of the present corner bead.
Figure 2:
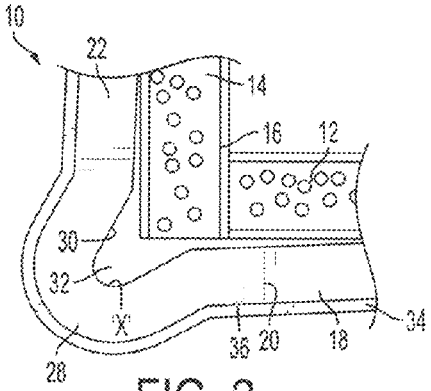
FIG. 2 is an enlarged fragmentary end view of the bead of FIG. 1.
Figure 3:
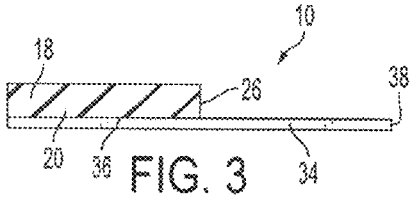
FIG. 3 is a fragmentary enlarged end view of a free edge portion of the present corner bead body.

Referring now to FIGS. 1-4, the present corner bead is generally designated 10, and is constructed and arranged to be positioned on an outside corner joint defined by edges of adjacent wallboard panels 12 and 14 forming a corner 16, preferably a 90° corner (FIG. 2), however other angles are contemplated and are contemplated to be at least in the range of 75°-105°.

Advantages of the present corner bead 10 include that it has a particular geometry, and is made of plastic so that shock impacts are more readily absorbed than in conventional metal or plastic corner bead products. In addition, any damage incurred by such shock impacts is more readily repaired than with conventional products.

Included on the bead 10 is a body 18 having a first, preferably planar flange or wing 20 and a second, preferably planar flange or wing 22, both flanges being panel-like in configuration. Each flange 20, 22 has a rib edge 24 and an opposite free edge 26. The respective rib edges 24 of each of the flanges 20, 22 are joined to form a corner rib 28 defining an angle α. In the preferred embodiment, the angle α is approximately 85° and more preferably is less than 90° to exert a clamping force on the corner 16 upon assembly. However, it is contemplated that the exact dimension of the angle α may vary to suit the situation.

A feature of the present corner bead 10 is that the corner rib 28 extends beyond an intersection 'X' (FIG. 2) of planes defined by the first and second flanges 20, 22, has an interior side 30 and defines a hollow interior space 32. In other words, the corner rib 28 extends beyond a point at which the rib edges 24 would meet if they did intersect. More specifically, the corner rib 28 projects in the approximate range of 0.015-0.035 inch (0.04-0.09 cm) beyond an exterior surface of the flanges 20, 22. However, the hollow interior space 32 separates the two rib edges 24. In the preferred embodiment, the corner rib 28 is radiused along its length, and defines a radius in cross-section in the range of 0.03-0.10 inch (0.08-0.25 cm).

Another feature of the present corner bead is that at least one, and preferably both of the flanges 20, 22 taper in thickness from the rib edge 24 to the free edge 26, so that the free edge is relatively pointed compared to the rib edge. Thus, the flanges 20, 22 are mirror images of each other. This tapered configuration facilitates the user blending the corner bead 10 into the wall through the use of wallboard joint compound and a taping knife, as is well known in the art. In addition, the taper provides gradually increasing strength to the bead 10 closer to the corner rib 28, where shock impacts are more likely to occur. The gradually tapering cross-section towards the free edge 26 facilitates more efficient use of material. While other thicknesses are contemplated depending on the application and material used, in the preferred embodiment, the thickness of the flanges 20, 22 near the corner rib 28 is in the range of 0.040-0.055 inch (0.10-0.14 cm), and near the free edge 26 is in the range of 0.025-0.035 inch (0.06-0.09 cm).

In the preferred embodiment, the body 18 is integrally formed and is made of plastic, preferably of a type which is injection moldable or extrudable, including but not limited to polystyrene, polyvinylchloride (PVC), polyethylene (PET), and polycarbonate. In the present application, "plastic" will be understood to refer to any polymeric material, whether or not filled with fibers, minerals or other additives known in the art, including, but not limited to those materials identified above. In addition, the plastic is selected for impact resistance, and is reversibly deformable.

In addition to the body 18, described above, the present corner bead 10 also preferably includes a web of face paper 34 covering at least a portion of the body. Chemical adhesives or other known fastening technology is used to secure the face paper 34 to the body 18. In the preferred embodiment, the face paper 34 covers an exterior 36 of the entire body 18. The face paper 34 preferably envelops the body 18 and provides a substrate to which wallboard joint compound readily adheres for facilitating finishing of the corner joint.

Figure 4:
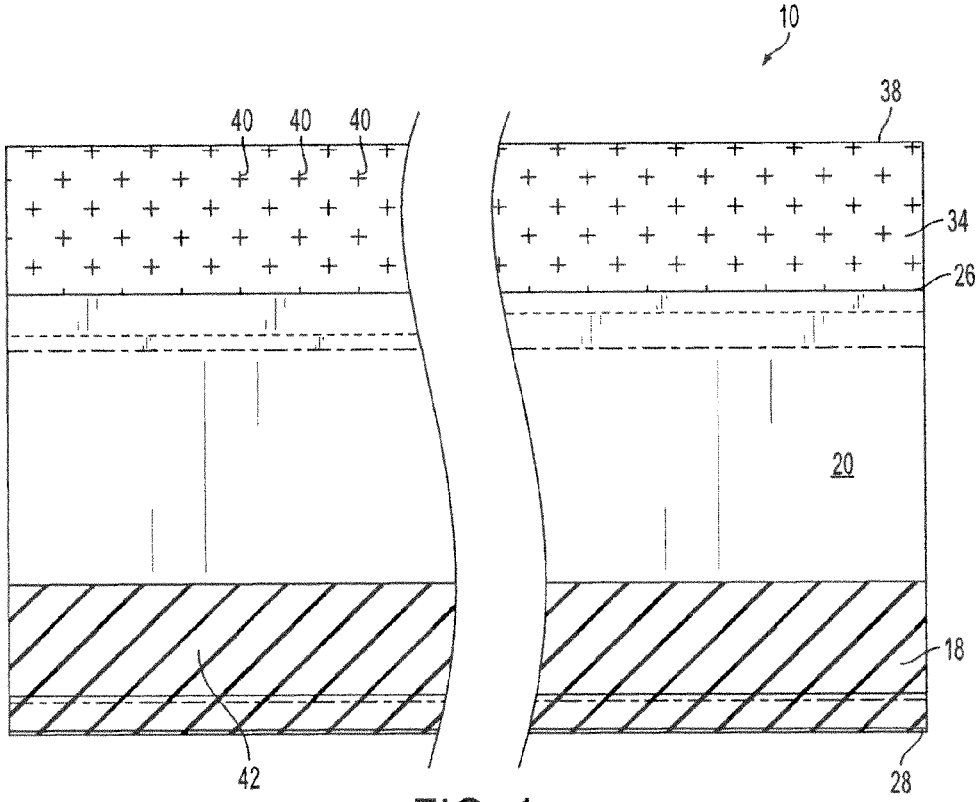
FIG. 4 is a fragmentary side view of the corner bead of FIG. 1.

As is seen in FIGS. 1 and 4, the face paper 34 has a free end 38 extending past the free edge 26 of each of the flanges 20, 22. More specifically, a length ratio of the free edge 26 to the face paper free end 38 is approximately 0.5-0.9, and preferably approximately 0.7. Also, as seen in FIG. 4, the face paper 34 is optionally at least partially treated by pin pricking, creating perforations 40, which in some cases facilitate the bonding and curing of the wallboard joint compound. Preferably, the face paper 34 is also coated with a thin, wax-like nose coating 42 (FIGS. 4 and 5) to facilitate sliding of the taping knife or trowel used to apply the wallboard joint compound.

Figure 5:
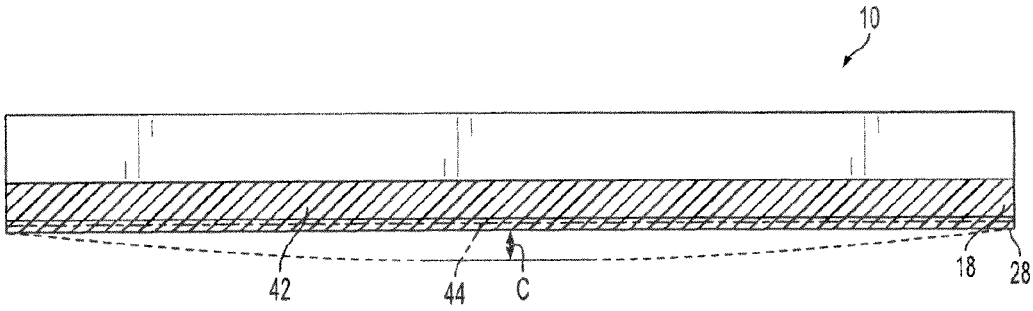
FIG. 5 is a side view of a cut portion of the corner bead of FIG. 1.
Figure 6:
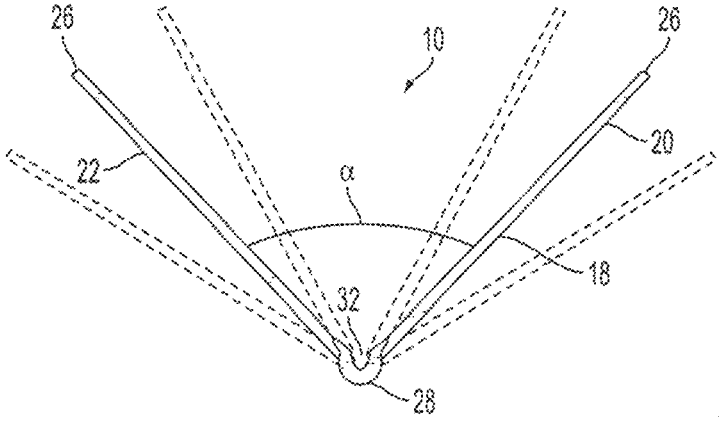
FIG. 6 is an end elevational view of the present corner bead.

Referring now to FIG. 5, to compensate for wall irregularities, the corner bead 10 is provided with a slight inward camber or progressive, transverse bias along its length, represented by the elongate bowed dashed line in FIG. 5, referred to as a bow camber. Thus, while the appearance of the bead 10 from the side is rectangular as seen in FIG. 5, the bead has an inherent bias towards the center 44, measured at point 'C' where the bias is strongest, as approximately 0.125 inch (0.3125 cm) over an approximate bead length of 8-12 feet (2.44-3.66 meters). It will be understood that the bias measurement referred to immediately above may vary to suit the application and/or the particular plastic used to make the bead 10. Referring now to FIG. 6, due to manufacturing variations inherent with the extrusion process, the angle α should not vary ±15° over its length.

Figure 7:
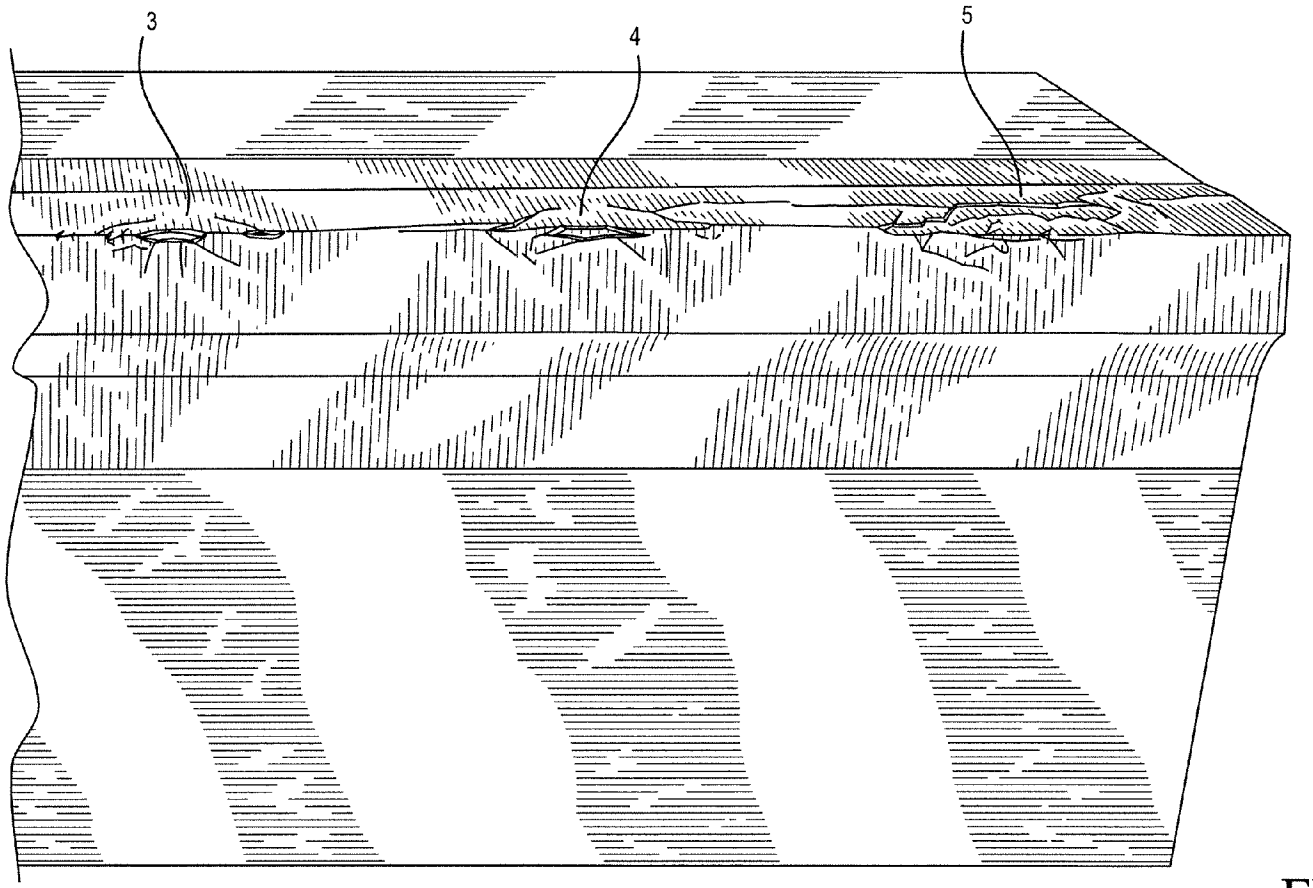
FIG. 7 is a photo of a prior art metal bead after impact with a 1.2 lb ball dropped from various heights and the resulting damage.

FIG. 7 is a photograph depicting a prior art metal corner bead upon which a relatively light (1.2 lb, 0.54 Kg) ball has been dropped from different heights in the range of 4 feet (1.22 m). The numbers "3," "4," and "5" refer to impacts from the ball. At impact point 3, the corner is dented, at impact point 4 in addition to the dent, the bead has begun to detach from the wallboard, and at impact point 5 the bead has separated from the wallboard. It is evident that fairly extensive damage results.

Figure 8:
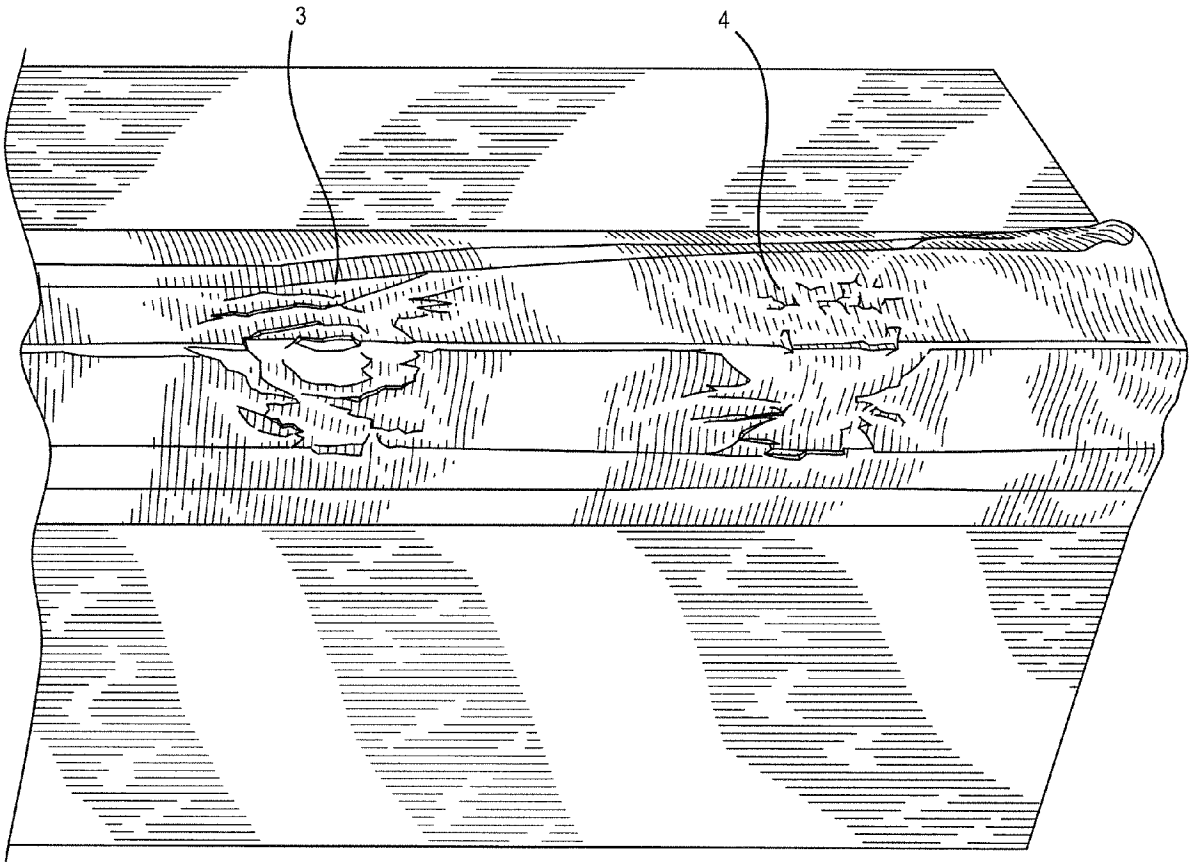
FIG. 8 is a photo of a prior art plastic bead having a sharp 90° corner, impacted by a relatively heavier 3.4 lb weight compared to FIG. 7, and depicting the resulting damage.

FIG. 8 shows a conventional plastic bead finished with paper-faced bead held in place only by joint compound, which acts as an adhesive to glue the bead to the drywall surface. The test corner had a sharp 90° corner impacted at impact points "3" and "4" by a relatively heavier ball (3.4 lb, 1.54 Kg), because the ball from FIG. 7 does almost no damage the plastic bead when dropped from the same heights. The photos reveal that the corner does not crush, but the impact causes the plastic to break at the corner, and the forces are then translated to flattening out the angled plastic piece, which pulls the flanges away from the wallboard. Thus, in this example, the corner bead is no longer attached to the wallboard, requiring a major repair that involves cutting out the impacted area and installing a new piece.

Figure 9:
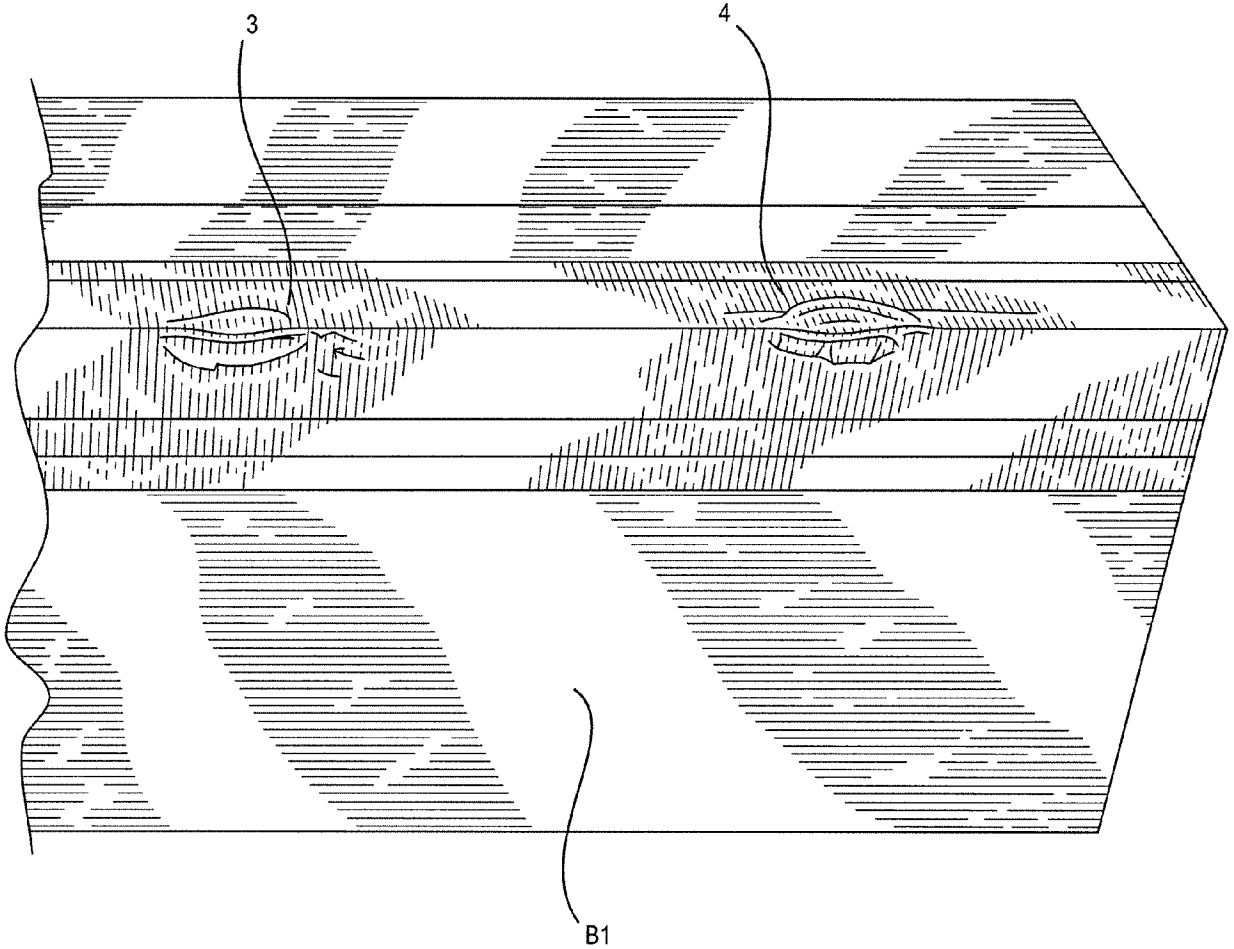
FIG. 9 is a photo of the present corner bead, impacted with the same 3.4 lb weight as used in FIG. 8.

FIG. 9 shows the present corner bead 10, impacted by the same weight as in FIG. 8. The corner rib 28 absorbs the impact as seen at impact points "3" and "4", partially crushing and creating a dent, but the flanges 20, 22 remain attached to the wallboard. This type of damage is more easily repaired using SPACKLE® surfacing compound, wallboard joint compound or the like, then sanded and finished using conventional techniques.

Thus, the present corner bead accommodates impact damage better than conventional metal corner beads or rigid, right angled plastic corner beads. What damage that is suffered by the present corner bead is more readily repaired.

While particular embodiments of the present impact resistant plastic corner bead have been described herein, it will be appreciated by those skilled in the art that changes and modifications may be made thereto without departing from the invention in its broader aspects and as set forth in the following claims.

What is claimed:

1. A corner bead for finishing a wallboard corner joint, comprising:

a plastic body having a length, and including a first flange and a second flange each extending generally transverse to said length, each said flange having a rib edge and an opposite free edge, said respective rib edges being joined to form a corner rib and defining an angle;

a web of face paper at least partially covering said body;

said corner rib extends beyond a corner defined by an intersection of planes defined by said first and second flanges, has an interior and defines a hollow interior space;

said plastic construction of said corner bead being reversibly deformable and configured for absorbing an impact, and for facilitating a maintenance of adhesion of said first and second flanges to the wallboard in response to the impact;

at least one of said flanges tapers in thickness from said rib edge to said free edge; and said corner bead is provided with a bow camber along said length such that said body has a progressive transverse bias that is greatest at a center of said length.

2. The corner bead of claim 1 wherein said plastic is taken from the group consisting of polystyrene, PVC, PET, and polycarbonate.

3. The corner bead of claim 1 wherein said flanges have a thickness in the range of 0.40-0.55 inch near said corner rib and a thickness in the range of 0.025-0.035 inch near said free edge.

4. The corner bead of claim 1 wherein said flanges are mirror images of each other, having corresponding tapering cross-sectional profiles.

5. The corner bead of claim 1 wherein said face paper has a free end extending past said free edge of each of said flanges.

6. The corner bead of claim 5 wherein a length ratio of said free edge to said face paper end is approximately 0.5 to 0.9.

7. The corner bead of claim 1 wherein said corner rib projects approximately 0.015-0.035 inch beyond an exterior surface of said flange.

8. The corner bead of claim 1 wherein said defined angle is in the range of 75°-105°.

9. The corner bead of claim 1, wherein said face paper is coated with a nose coating.

10. A corner bead for finishing a generally right angle wallboard corner joint, comprising:

a plastic body having a length and including a first flange and a second flange, each said flange having a rib edge and an opposite free edge, said respective rib edges being joined to form a corner rib and defining an angle;

a web of face paper at least partially covering said body;

said corner rib extends beyond a corner defined by an intersection of planes defined by said first and second flanges, has an interior and defines a hollow interior space;

said plastic construction of said corner bead being reversibly deformable and configured for absorbing an impact, and for facilitating a maintenance of adhesion of said first and second flanges to the wallboard in response to the impact;

at least one of said flanges tapers in thickness from said rib edge to said free edge;

wherein said corner rib defines a radius in cross-section in the range of 0.03-0.10 inch for forming a generally right angle corner joint; and said corner bead is provided with a bow camber along said length such that said body has a progressive transverse bias that is greatest at a center of said length.

11. A corner bead for finishing a wallboard corner joint, comprising:

a plastic body having a length and including a first flange and a second flange each extending generally transverse to said length, each said flange having a rib edge and an opposite free edge, said respective rib edges being joined to form a corner rib defining an angle;

at least one of said flanges tapers in thickness from said rib edge to said free edge;

said corner rib extends beyond a corner defined by an intersection of planes defined by said first and second flanges, said corner rib extending beyond an exterior surface of said flanges, and has an interior and defines a hollow interior space, said corner rib being configured for absorbing shock impacts to the corner joint; and a web of face paper at least partially covering said body, wherein said corner bead is provided with a bow camber along said length such that said body has a progressive transverse bias that is greatest at a center of said length, said bias acting in a direction of extension of said flanges from said corner rib.

12. The corner bead of claim 11, wherein said face paper is perforated.

13. The corner bead of claim 11, wherein said face paper is coated with a nose coating.

* * * * *